United States Patent [19]

Vogl

[11] Patent Number: 4,571,108

[45] Date of Patent: Feb. 18, 1986

[54] LOCKING RING BINDER MECHANISM WITH CONTROL SLIDE

[76] Inventor: Kurt Vogl, 621 Terrill Rd., Fanwood, N.J. 07023

[21] Appl. No.: 444,734

[22] Filed: Nov. 26, 1982

[51] Int. Cl.[4] ..... B42F 3/04; B42F 13/20

[52] U.S. Cl. ..... 402/38; 402/39; 402/41

[58] Field of Search ..... 402/30, 38, 39, 40, 402/41

[56] References Cited

U.S. PATENT DOCUMENTS

| | | | |
|---|---|---|---|
| 974,831 | 11/1910 | Scherzinger | 402/41 |
| 1,897,001 | 2/1933 | Dawson | 402/40 |
| 2,013,416 | 9/1935 | McClure | 402/38 |
| 2,439,675 | 4/1948 | Segal | 402/40 |
| 2,612,169 | 9/1952 | Segal | 402/38 |

*Primary Examiner*—Paul A. Bell
*Assistant Examiner*—Taylor J. Ross
*Attorney, Agent, or Firm*—Davis, Hoxie, Faithfull & Hapgood

[57] ABSTRACT

This is a device for holding sheets of paper in a loose-leaf notebook. The mechanism comprises rings upon which the sheets are filed, a deformable surface which controls the action of the rings, a control slide which alters the shape of the surface, a cover and a base. The shape of the control slide, base and cover assure positive control over the position of the rings.

11 Claims, 4 Drawing Figures

LOCKING RING BINDER MECHANISM WITH CONTROL SLIDE

Figure 2:
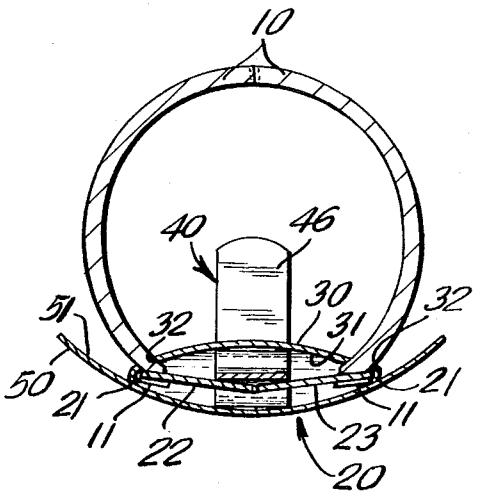

This invention relates to loose-leaf notebooks in which sheets of paper are filed upon arches or rings. The arches or rings, substantially circular in form as found in most prior art embodiments, comprise opposed halves of substantially semicircular segments aligned in a common plane. Alternative embodiments of the invention may employ substantially rectangular, triangular or other odd-shaped arches. The half-segments separate to receive sheets of paper and unite to prevent escape thereof. Each pair of half-segments is joined together in hinged relation at one end, designated the attached end. Connecting the attached ends in this manner allows the other ends, designated the free ends, to separate and unite as the rings are opened and closed. When the rings are closed their free ends abut each other, interlocking teeth formed at each end.

Prior art notebooks of this general type are well known. The mechanisms in such prior art devices generally utilize opposed half-segments attached, at their attached ends, to plates which are joined together in hinged relation. The plates are rectangular in shape and are arranged adjacent to each other. The assembly of the connected plates is suspended within the notebook's binder by attaching the assembly's lateral edges in hinged relation to the sides of the binder. Alternative embodiments attach the plates' lateral edges to the lateral edges of either the cover or base of the binder. Together, the cover and base provide a protective enclosure for the plates and other elements of the device. The dimensions of the plates, cover and base are chosen such that nesting the plates' assembly within either cover or base creates a spring tension in the assembly's hinge. The width separating the connections of the plates' lateral edges to either the base or cover is less than the overall width of the plates as connected together. The combined structure of the plates and cover or the plates and base forces the plates to assume either one of two configurations. At equilibrium, the shape of the assembly of the connected plates, or deformable surface, is either upwardly convex (crown-shaped) or upwardly concave (V-shaped).

The deformable surface is changed from one configuration to the other by applying pressure to one side of the surface at points near the hinge connecting the plates together. Pressure is applied to the deformable surface by a control slide. Various alternative embodiments incorporate mechanisms attached to the control slide which contact the deformable surface near the line of connection between the plates created by the hinge. For example, in one prior art mechanism, pressure is applied at two points along this line. Two openings are provided for in the deformable surface along this line. Within each opening extend flanges perpendicular to the line of connection. The flanges function as an axle for a roller bearing which fits within each opening. The control slide is situated in a plane parallel to that containing the lateral edges of the deformable surface. It also moves back and forth in the same direction that the lateral edges extend. The slide has members which vertically extend from the plane in which the slide is located and protrude through the deformable surface through each opening therein. Each of these members contains a roller bearing mounted so that back and forth movement of the slide causes the roller bearing to be vertically displaced relative to the control slide. This vertical displacement results in pressure applied to the flanges and, ultimately, a reversal of the configuration of the deformable surface.

The deficiencies of the prior art are (1) no secure locking of the rings in open or closed position and (2) complicated construction of and arrangement of elements comprising the mechanism. The prior art devices utilize various odd-shaped parts. Their designs also minimize friction between moving parts, a feature intended to facilitate smooth operation of the binder mechanism. Unfortunately, because of these design characteristics, none of the known designs securely locks the rings in either open or closed configuration. Also, the incorporation of odd-shaped elements and moving parts results in a device which is difficult to mass-produce.

The principal object of this invention is to provide a mechanism which strongly secures the rings in either open or closed configuration. This object is accomplished in the present invention by compressing the control slide between the mechanism's cover and base, thereby restricting vertical movement of the control slide and creating considerable friction between the surface of the slide and the inner surfaces of both the cover and base. The friction prevents any unintentional movement of the slide which might otherwise occur, causing the rings to open. In addition, the control slide includes cam-shaped portions which interact with the plates to prevent the rings from changing their configuration as long as the slide is secured. The cam portions also interact with the plates when the slide is moved to transfer pressure to the plates, thereby causing them to change their configuration.

When the rings are in closed position, the slide is secured by a protrusion in its upper surface located near the control end of the slide. This is the end which one grasps to pull or push the slide in order to open or close the rings. The shape of the control slide at this end forms a handle. This protrusion, or shear stop, engages a hole in the cover which prevents any accidental movement of the slide. When pressure is applied to the control end of the slide, the shear stop disengages from the hole in the cover allowing the slide to move.

In the prior art, little consideration is given to securing the rings. This invention utilizes a control slide compressed between the cover and base, protrusions in the shape of the slide's cam portions which prevent the plates from moving, and a shear stop to prevent accidental opening of the rings, all of which contribute to locking the rings in open or closed position while at the same time providing a mechanism which opens or closes the rings. In the invention, there is greater contact between the slide and the plates than there is in the prior art. In addition, significant surface contact occurs between the slide and the base and also between the slide and the cover, not present in any known prior art design. Although more pressure is required to move the slide, the increased friction results in surer movement of the slide and more secure maintenance of the rings in either open or closed position.

Another object of this invention is to provide an improved mechanism to hold sheets of paper which is economical and easy to contruct, having a minimal number of moving parts. The shape of the control slide facilitates direct transfer of pressure to the plates. The slide generally resembles a ribbon or serpent. Most of its length consists of flat sections spaced from, but parallel to the deformable surface. The slide's cam portions which extend through the deformable surface comprise flat sections spaced from, but parallel to the deformable surface on the opposite side of the surface from adjacent flat sections. Slanted sections which pass through openings in the deformable surface connect all of the slide's flat sections together completing the cam portion's structure. Protrusions in the slanted sections, uniform along the slide's width, provide stops which obstruct movement of the plates when the slide is secured in either open or closed position. As the slide moves back and forth, the slanted sections contact the deformable surface. Contact is made between the slide's width and the edges of the surface's openings which extend perpendicular to the direction in which the slide moves. Movement of the slide forces the plates to change their configuration. The flat sections contact the protective cover and base at all times, compressing the slide and preventing any vertical displacement of it relative to the other elements of the device. Use of the ribbon-shape reduces the number of moving parts and reduces the complexity of the mechanism responsible for transfer of pressure. The present invention basically has only five different components: the rings, the plates, the slide, the cover, and the base, none of which is difficult to manufacture.

Figure 1:
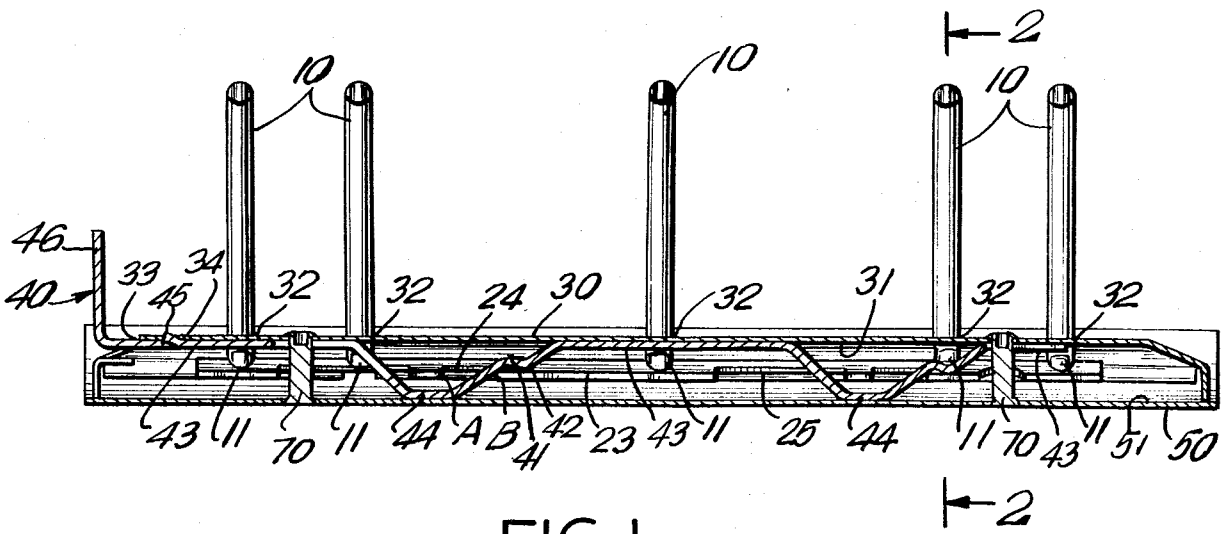
Figure 4:
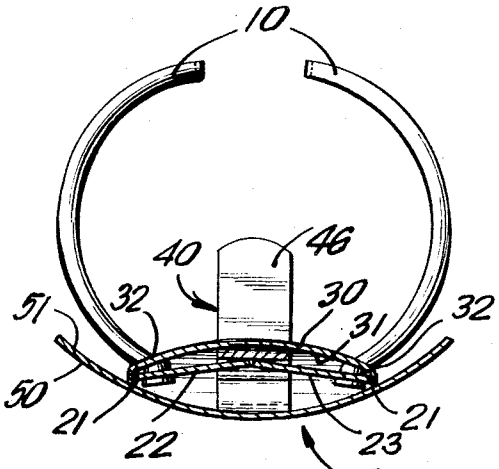
Figure 3:
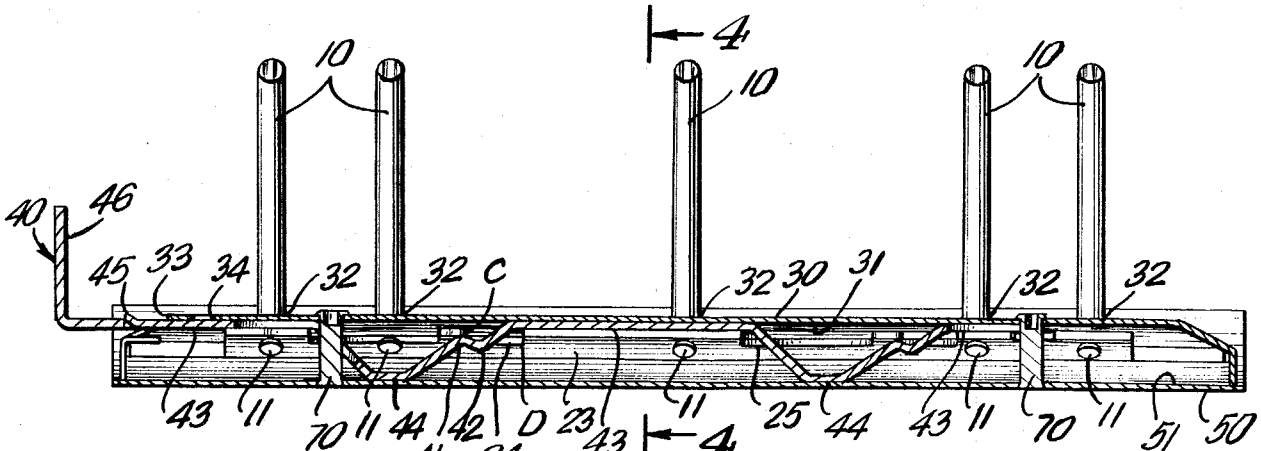

The foregoing as well as other objects and features will be made more apparent as this description proceeds, especially when considered in connection with the accompanying drawing, wherein:

FIGS. 1 and 3 are side plan views of the mechanism embodying the features of the present invention showing the rings in, respectively, closed locked position and open locked position; and FIGS. 2 and 4 are cross-sectional views of the mechanism showing the rings in, respectively, closed locked position and open locked position taken along the lines 2—2 and 4—4 in FIGS. 1 and 3.

In the drawings, reference number 10 indicates the rings or arches employed for holding sheets of paper. They are arranged in common planes spaced apart such that the free ends of the rings or arches pierce the sheets at various points along their entire length. The attached ends of the rings or arches 10 are fixed to the plates 22 and 23 at points 11 near the lateral edges 21 of the plates. The two plates are joined together in hinged relation and comprise the deformable surface which is generally rectangular in shape. Cover 30 and base 50 are stiff resilient members which enclose and interact with the other parts of the mechanism. The deformable surface is suspended between the two by attaching the plates' lateral edges 21 in hinged relation to cover 30.

In FIG. 2, which shows the rings in closed position, the deformable surface assumes an upwardly concave or V-shaped configuration. This configuration tilts the plates 22 and 23 on which the half-segments comprising each ring 10 are attached toward the centerline of the mechanism. This causes the rings or arches 10 to close. In FIG. 4, which shows the rings in open position, the deformable surface, plates 22 and 23, assumes an upwardly convex or crown-shaped configuration. This configuration tilts the plates 22 and 23 away from the centerline of the mechanism causing the rings or arches 10 to open. Because plates 22 and 23 are flat, the bending of the deformable surface toward the rings' centerline or away from their centerline is uniform along the device's length. This insures that all rings 10 uniformly open and close.

In the drawing, the deformable surface appears as two rigid plates 22 and 23 joined together in hinged relation. Alternative embodiments of the deformable surface could comprise a flexible sheet absent the hinge but joined to the cover 30 along same edges 21 or three or more rigid plates joined to each other by hinges and joined to the cover similarly.

The control slide 40, best seen for most purposes in FIGS. 1 and 3, is shaped such that slanted sections of it pass through openings 24 and 25 along the centerline of the deformable surface. Points A, B, C, and D in FIGS. 1 and 3 show where contact is made between the control slide 40 and the deformable surface. The control slide 40 is shaped such that flat sections of it press against both cover 30 and base 50.

FIG. 1 shows the mechanism when the rings 10 are closed. As the control slide 40 is pulled out to open the rings (to the left in FIG. 1) movement of the slanted section of the slide 40 between points A and B causes the edge of the deformable surface at point A to contact the slide. Further movement of the slide in this direction forces the edge at point A to ride up the slide's slanted section, changing the configuration of the deformable surface from the plates' upwardly concave shape (as shown in FIG. 2) to their upwardly convex shape (as shown in FIG. 4). This occurs because the relative space between the slide and the cover at point A is reduced. A protrusion or stop 41 found at one end of the slide's slanted section passes underneath the deformable surface near point A and supports the surface in its upwardly convex shape.

FIG. 3 shows the mechanism when the rings are locked open. When the control slide 40 is pushed in to close the rings (to the right in FIG. 3), movement of the slide's slanted section between points C and D, which is a different section from that involved in the movements which open the rings, causes the edge of the deformable surface at point D to contact the slide. Further movement of the slide in this direction forces the edge at point D to ride down the slanted section, changing the configuration of the deformable surface back to its upwardly concave shape. This occurs because the relative space between the slide and the cover at point D is increased. A protrusion or stop 42 formed into the slide's slanted section slips over the deformable surface near point D at the end of the control slide's movement obstructing changes in the plates' configuration.

Of particular importance is the role played by the inner surface 31 of the cover 30 and the inner surface 51 of the base 50 rubbing against the control slide 40 as it is pushed or pulled. This contact is important. As mentioned before, when the control slide 40 is pushed in to close the rings 10, it contacts an edge of the opening 24 in the deformable surface at point B. Unless movement of the control slide 40 is restricted vertically by the inner surface 31 of the cover 30 against flat sections 43 of the control slide 40, the control slide 40 will displace vertically instead of transferring any pressure to the deformable surface. When the control slide 40 is pulled out to open the rings, similar interaction occurs between flat sections 44 of the control slide 40, the edge of the deformable surface at point A and the inner surface 51 of the base 50. The base 50 prevents any vertical displacement of the control slide thus transferring all pressure to the edge of the deformable surface at point A forcing it to change its configuration. Contact between the surfaces 31 and 51 and the control slide 40 creates friction which significantly inhibits the control slide's ease of movement.

The cover 30 and base 50 protect the mechanism from damage. Openings shown as 32 in the drawing must be provided for in the cover 30 to permit the rings 10 to pass through. Another opening 33 must be provided to allow the control slide 40 to emerge through the cover 30. This results in an almost completely sealed enclosure for the mechanism.

The figures also depict the shear stop 45, a protrusion formed on the top side of the control slide near the slide's handle 46. This protrusion is positioned on the control slide 40 such that when the slide is pushed in closing the rings, the protrusion engages a hole 34 in the cover 30 preventing accidental opening of the rings 10. Slight downward pressure applied to the handle 46 which bends the control slide 40 disengages the shear stop 45 from the hole 34 so that the control slide 40 may be pulled out opening the rings.

Fasteners 70 are used to secure the base 50 to the cover 30. Passages are provided for the fasteners 70 in the deformable surface 20, the control slide 40, and the cover 30. The passages in the control slide allow the fastener to pierce the slide while allowing movement of the slide to open and close the rings. As depicted, the lateral edges 21 of the deformable surface are attached in hinged relation to the cover 30 and the base 50 is secured to the cover 30. Alternatively, the lateral edges 21 could be attached in hinged relation to the base 50 and the cover could be secured by rivets 70 to the base 50.

I claim:

1. An improvement in loose-leaf binder ring mechanisms comprising:

a deformable member comprising a pair of elongated, generally rectangular plates abutting in hinged relationship along the longitudinal axis of the deformable member, the deformable member having a first aperture and a second aperture located along the longitudinal axis;

a plurality of parallel leaf holding rings located in separate planes perpendicular to the longitudinal axis of the deformable member, each ring comprising two opposed portions, each ring portion having an attached end secured to one of the rectangular plates of the deformable member, and each ring portion having a free end opposing the free and of the other ring portion and meeting the other ring portion when the rings are in their closed position;

a stiff, but resilient cover over the deformable member and a base under the deformable member, the cover engaging the deformable member so that the deformable member is biased into one of two equilibrium configurations, upwardly convex and upwardly concave, the free ends of the ring portions being spaced apart in a binder-open position when the deformable member is in the upwardly convex configuration and the free ends of the ring portions being in abutment in a binder-closed position when the deformable member is in an upwardly concave configuration;

a control slide located between the cover and base which holds the rings alternatively in the binder-open and binder-closed positions, the control slide being longitudinally moveable between a first position in which the rings are closed and a second position in which the rings are open, the control slide having means protruding outside the cover for the user to grip and actuate the control slide;

the improvement wherein the control slide comprises an elongated member extending parallel to the longitudinal axis of the deformable member, one end of the control slide being located between the cover and the deformable member, the control slide then passing through the first aperture, extending between the base and the deformable member to the second aperture, passing through the second aperture, and extending for a further distance between the cover and the deformable member;

the control slide having a sloping cam on its upper surface which engages a first edge of one of said apertures as the control slide is moved from the first position toward the second position while another portion of the control slide bears on the base, forcing the deformable member into its upwardly convex configuration and bringing a portion of the control slide beneath the deformable member, causing the rings to open and holding them open, and the control slide having a further sloping cam on its lower surface which engages a second edge of said one of said apertures as the control slide is moved from the second position to the first position while another portion of the control slide bears on the cover, forcing the deformable member into its upwardly concave configuration and bringing a portion of the control slide above the deformable member, causing the rings to close and holding them closed.

2. The improvement in ring binder mechanisms of claim 1 wherein the entire width of said control slide in the vicinity of said first aperture does not exceed the width of the portion of said first apertures through which said control slide passes and the entire width of said control slide in the vicinity of said second aperture does not exceed the width of the portion of said second aperture through which said control slide passes.

3. The improvement in ring binder mechanisms of claim 1 wherein said control slide is of constant width throughout its operative length.

4. The improvement in ring binder mechanisms of claim 1 wherein the spacing between said base and said cover along their major longitudinal axes is substantially the same as the height of said control slide from its portion closest to said base to its portion closest to said cover.

5. The improvement in ring binder mechanisms of claim 4 further comprising a plurality of fastener means fastening said cover to said base, a plurality of fastener apertures in said cover, a plurality of fastener apertures in said deformable member, a plurality of fastener apertures in said control slide and a plurality of fastener apertures in said base; each such fastener means passing through one of said fastener apertures in said cover, through one of said fastener apertures in said deformable member, through one of said fastener apertures in said control slide and through one of said fastener apertures in said base.

6. An improvement in loose-leaf binder ring mechanisms comprising:

a deformable member comprising a pair of elongated, generally rectangular plates abutting in hinged relationship along the longitudinal axis of the deformable member, a plurality of parallel leaf holding rings located in separate planes perpendicular to the longitudinal axis of the deformable member, each ring comprising two opposed portions, each ring portion having an attached end secured to one of the rectangular plates of the deformable member, and each ring portion having a free end opposing the free end of the other ring portion and meeting the other ring portion when the rings are in their closed position;

a stiff, but resilient cover over the deformable member and a base under the deformable member, the cover engaging the deformable member so that the deformable member is biased into one of two equilibrium configurations, upwardly convex and upwardly concave, the free ends of the ring portions being spaced apart in a binder-open position when the deformable member is in the upwardly convex configuration and the free ends of the ring portions being in abutment in a binder-closed position when the deformable member is in an upwardly concave configuration;

a control slide located between the cover and base which holds the rings alternatively in the binder-open and binder-closed positions, the control slide being longitudinally movable between a first position in which the rings are closed and a second position in which the rings are open, the control slide having means protruding outside the cover for the user to grip and actuate the control slide;

the improvement wherein the control slide comprises a stiff ribbon having a plurality of control slide sections arranged longitudinally in sequence as follows a first slide section located at and extending on an upper level adjoining the cover, a second slide section extending downward to a lower level adjoining the base, a third slide section extending upwardly to a first intermediate level between the upper and lower levels, a fourth slide section extending downwardly to a second intermediate level between the first intermediate level and the lower level, a fifth slide section extending upwardly to the upper level, and a sixth slide section extending on the upper level adjoining the cover;

the deformable member having a first aperture and a second aperture located along the central longitudinal axis;

the second slide section passing through the first aperture from the upper level to the lower level;

the control slide passing through the second aperture in the vicinity of the third through fifth sections, the location of said sections with respect to the second aperture depending upon the longitudinal position of the control slide, the third slide section having a sloping cam on the upper surface of the control slide which engages a first edge of the second aperture as the control slide is moved from the first position toward the second position while the lower level of the control slide bears on the base, forcing the deformable member into its upwardly convex configuration and bringing the first intermediate level of the control slide beneath the deformable member, causing the rings to open and holding them open, the fifth slide section having a sloping cam on the lower surface of the control slide which engages a second edge of the second aperture as the control slide is moved from the second position to the first position while the upper level of the control slide bears on the cover, forcing the deformable member into its upwardly concave configuration and bringing the second intermediate level of the control slide above the deformable member, casing the rings to close and holding them closed.

7. The improvement in loose-leaf binder ring mechanisms of claim 6 wherein the deformable member is further provided with a plurality of sets of apertures corresponding to the first and second apertures, and the control slide is provided with a plurality of sets of sections corresponding to the first through sixth sections.

8. The improvement in ring binder mechanisms of claim 6 wherein the entire width of said control slide in the vicinity of said first aperture does not exceed the width of the portion of said first aperture through which said control slide passes and the entire width of said control slide in the vicinity of said second aperture does not exceed the width of the portion of said second aperture through which said control slide passes.

9. The improvement in ring binder mechanisms of claim 6 wherein said control slide is of constant width throughout its operative length.

10. The improvement in ring binder mechanisms of claim 6 wherein the spacing between said base and said cover along their major longitudinal axes is substantially the same as the height of said control slide from its portion closest to said base to its portion closest to said cover.

11. The improvement in ring binder mechanisms of claim 10 further comprising a plurality of fastener means fastening said cover to said base, a plurality of fastener apertures in said cover, a plurality of fastener apertures in said deformable member, a plurality of fastener apertures in said control slide and a plurality of fastener apertures in said base; each such fastener means passing through one of said fastener apertures in said cover, through one of said fastener apertures in said deformable member, through one of said fastener apertures in said control slide and through one of said fastener apertures in said base.

* * * * *

UNITED STATES PATENT AND TRADEMARK OFFICE

CERTIFICATE OF CORRECTION

PATENT NO. : 4,571,108

DATED : Feb. 18, 1986

INVENTOR(S) : Kurt Vogl

It is certified that error appears in the above-identified patent and that said Letters Patent is hereby corrected as shown below:

Col. 5, Claim 1, line 49, "and" should be --end--.

Col. 8, Claim 6, line 21, "casing" should be --causing--.

Signed and Sealed this

*First* Day of *July 1986*

[SEAL]

*Attest:*

DONALD J. QUIGG

*Attesting Officer*

*Commissioner of Patents and Trademarks*